United States Patent [19]

Corfield

[11] Patent Number: 4,727,644

[45] Date of Patent: Mar. 1, 1988

[54] CALIBRATING COMPONENTS

[75] Inventor: John C. Corfield, Ascot, England

[73] Assignee: Unimax Switch Limited, Wokingham, England

[21] Appl. No.: 898,675

[22] Filed: Aug. 21, 1986

[30] Foreign Application Priority Data

Aug. 21, 1985 [GB] United Kingdom ..... 8520992

[51] Int. Cl.[4] ..... H01H 11/00

[52] U.S. Cl. ..... 29/622; 200/340

[58] Field of Search ..... 29/622, 593, 602.1; 200/286, 287, 340; 83/360, 363

[56] References Cited

U.S. PATENT DOCUMENTS

| | | | |
|---|---|---|---|
| 2,358,658 | 9/1944 | Riche et al. | 200/340 |
| 2,374,986 | 5/1945 | Fetter | 200/340 |
| 3,244,846 | 4/1966 | Kopp | 200/340 |
| 4,463,237 | 7/1984 | Kim | 200/340 |

*Primary Examiner*—P. W. Echols

*Attorney, Agent, or Firm*—Scrivener and Clarke

[57] ABSTRACT

A component having an externally engaged actuating member which effects an internal change at what is required to be a closely repeatable position in the movement of the member, e.g. a micro-switch actuated by a push button, is calibrated by progressively moving the actuating member while sensing for the internal change then, when the change occurs, clamping the actuating member (e.g. the push button) and cutting it to length.

7 Claims, 3 Drawing Figures

CALIBRATING COMPONENTS

This invention relates to the calibration of mechanically moving components on an automatic production basis so as to ensure consistency of behavior between one component and the next.

In the manufacture of electric snap-action switches actuated by displacement of a push-button or plunger, for example so-called micro-switches, it is desirable to ensure that each switch 'snaps', i.e. changes over its state in, as far as possible, exactly the same position in the travel of the button. This is important for example, where the switch is to be incorporated in some larger assembly. In practice what is wanted is that the change-over should occur at a predictable position of the engaged tip of the button in relation to the housing or mounting lugs of the switch.

In ordinary production it is difficult to achieve this, as a consequence of normal manufacturing tolerances, and although many manufacturers offer a range of 'precision' snap-action switches which snap at an accurately consistent point in the travel of the actuator button this can only be achieved by designing the switch so that critical dimensions can be adjusted during assembly. The necessary testing and adjustment steps are labor-intensive, skilled, and expensive.

Nevertheless many applications call for an inexpensive switch with a closely controlled 'operate' position and at present manufacturers have to resort to selection by tolerance bands. This is not entirely satisfactory to the purchaser and it can leave manufacturer with a high percentage scrap.

The aim of the invention is therefore to devise a way of manufacturing switches, and possibly other devices actuated by a mechanical movement, so that each product has the same operating position (i.e. in the case of a micro-switch it operates at the same position of the button relative to the housing), yet without requiring expensive manual adjustment procedures or selection by tolerance bands.

According to the invention we propose that such products should be made by a process in which the actuating member (e.g. the button) is made initially of greater extent than required, each product is taken in turn and actuated by progressive displacement of that member, while monitoring for the 'operate' instant, and then as soon as operation takes place the actuating member is gripped and cut, or otherwise deformed, so that the resulting actuating surface of that member is at a predetermined geometrical position in relation to the remainder, e.g. the housing, of the product.

In the case of a micro-switch actuated by a push button, for example, the switch is placed in a jig which automatically makes electrical contact with appropriate terminals of the switch, and then the button is depressed by a plunger; as soon as it snaps over, as detected by a circuit connected to the terminals, a jaw moves in laterally to clamp the button against a fixed jaw, and then the button is cut to length, for example by a saw or broach of which the cutting path bears a fixed relationship to the position occupied by the housing of the switch in the jig.

It will be appreciated that this process can be made entirely automatic, including loading and unloading of the jig, and so it can be incorporated in existing production installations without requiring any additional labor, skilled or unskilled, and without slowing down production. Yet trials indicate that the invention will result in switches being produced to tolerances which are about one fifteenth of those accepted in the normal production process.

An example of the process of the invention, as applied to the production of snap switches, will now be briefly described with reference to the accompanying drawings, in which.

Figure 1:
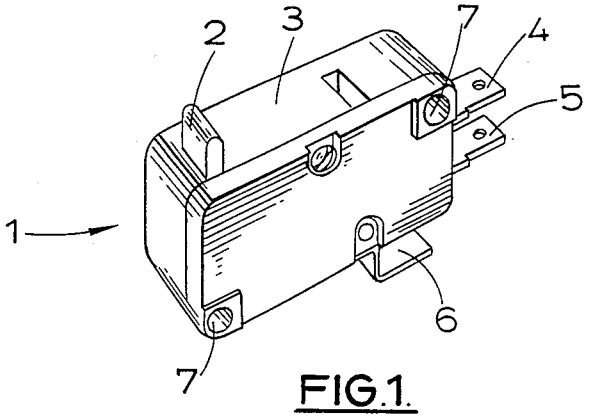
FIG. 1 is a perspective view of a standard form of micro-switch to which the invention is applied in this example.

The switch 1 is of basically well-known kind, such as that described in U.S. Pat. specification No. 3,965,316, although it could be of any similar kind, having an actuating button 2, movement of which inwards with respect to the housing 3 of the switch causes an internal moving contact, at a certain stage in that movement, to snap over suddenly from engagement with a contact connected to a terminal to engagement with a contact connected to terminal 5. The moving contact is itself connected to terminal 6. The switch has holes 7 at predetermined standard positions to receive screws or studs by which it is mounted.

The details of the internal mechanism of the switch are unimportant in relation to the present invention. What is important is that the sudden change-over should take place at an accurately determined position of the tip of the button 2 in relation to its surroundings, which in practice means in relation to the mounting holes 7 or the adjacent external surface of the housing 3. It is difficult to achieve this by internal adjustment except by the use of skilled labor.

Figure 2:
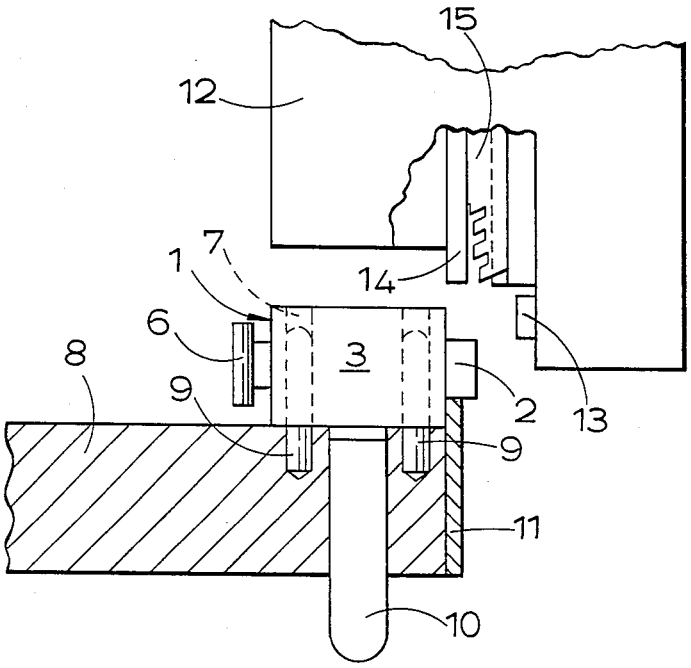
FIG. 2 is a diagrammatic elevation of a machine for performing the invention on the microswitch of FIG. 1.

For the purposes of the present invention we make the button 2 slightly longer than ultimately necessary. The switch 1 is placed on its side and accurately located in a predetermined position in a fixture 8 (FIG. 2) by the engagement of pins 9 in the mounting holes 7. The fixture 8 may be part of an indexing or conveyor system designed for automatic loading and unloading, and with this in mind there is an ejecting pin 10 in the fixture. A fixed jaw 11 on the fixture lies immediately below one side face of the actuating button 2 of the switch, but without interfering with its movement. The terminals 6 and 4 or 5 of the switch (not shown in FIG. 2) are in electrical contact with conductors (not shown).

Figure 3:
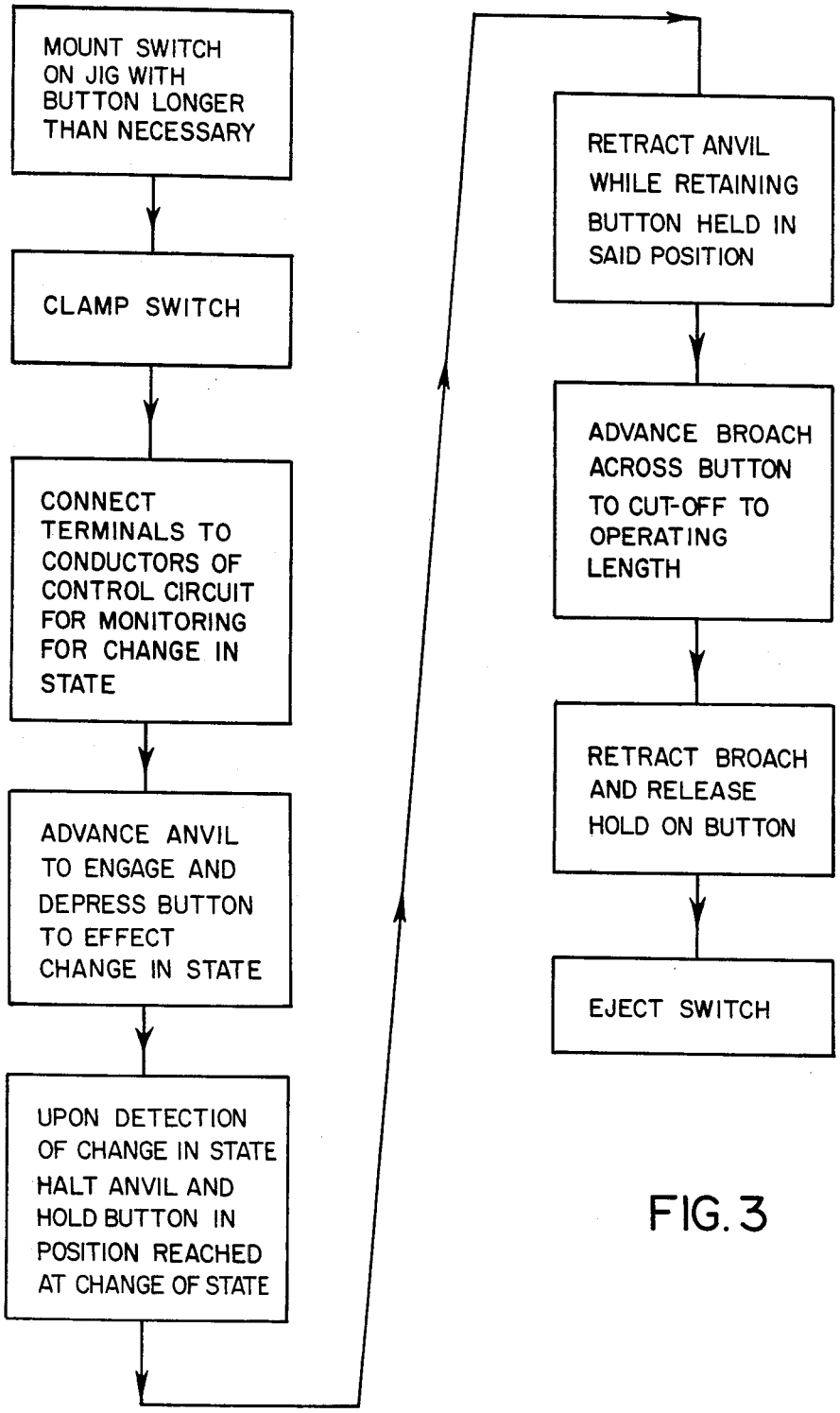
FIG. 3 is a block diagram showing the sequence of events in accordance with the invention.

In the sequence according to the invention as illustrated in FIG. 3 each switch is brought in turn from a loading station by the fixture and comes to rest adjacent a calibrating head 12, to be described, and in this position the conductors are connected to a control circuit.

The head 12 descends to clamp the switch 1 to the fixture and to bring an anvil 13 in line with the button 2. The anvil 13 then advances to the left, engaging the button 2 and depressing it. As soon the control detects that the switch has operated, it halts the anvil 13 and advances a sliding jaw 14 to clamp the button 2 against the fixed jaw 11. The anvil 13 retracts and a broach 15, guided in a slideway 16, passes across the button, cutting it off to the correct operating height.

It will be appreciated that the broach and the vice jaws can be profiled to the radius normally present on top of the actuating button of a snap switch, such that this radius is maintained during the machining operation.

After the broaching step the head 12 is retracted and the fixture moves the switch to an unloading station where it is ejected.

The sequence described above is rapid and totally automatic. Every switch emerges with the distance of the tip of the actuating button 2 from the housing 3 of the switch at the instant of changeover substantially exactly the same. All that is necessary is to assemble the switches initially with buttons which are not below a certain minimum length.

A broach is the easiest method of machining to length rapidly for actuating buttons moulded of plastics, but it will be understood that other methods may be used, e.g. a circular saw, handsaw, rotary milling cutter, or even a non-mechanical cutting method. In each case the object is the same, to end up with that surface of the actuator which is to be engaged by an external force occupying a predetermined position in relation to the housing of the switch at the instant of change-over.

There can be the usual safeguards. For example if the switch still fails to operate by the time the anvil 13 has advanced to a certain point beyond the normal range the switch can be ejected not at the usual station but at a reject station. Equally, if it operates too soon it can be ejected at the same or a different 'reject' station. These switches then reaching these stations are not necessarily too low or too high to correct by the process according to the invention but the presence of such suspect switches, falling outside predetermined limits before machining, gives an indication that attention may be required to an earlier stage in the production and assembly process.

While the invention has been described with reference to the calibration of electrical switches, the principle which it reveals can have wider applications, for example in any manufactured product where it is required that an event should take place within the product as the result of an externally applied force on an actuating member and that, from one sample of the product to the next, it should take place at the same position of the engaged surface of the actuating member in relation to the remainder of the product.

What is claimed is:

1. An automatic process for calibrating components of a kind including an actuating member on the component movable from a first position to a second position causing a change of state within said component, said actuating member having a greater extent than required to cause said change of state, the purpose of the calibration being to ensure that the change of state occurs at a predetermined position of an externally engageable surface of said actuating member in relation to the remainder of the component, said process comprising applying a force to said actuating member progressively to cause said member to move from said first position towards said second position while monitoring for the internal change of state, then, when said change of state occurs, holding said member in the position it has then reached and, while it is held, removing material from said member to form said externally engageable surface occupying said predetermined position.

2. The process set forth in claim 1 in which said removal of material comprises cutting said member to expose a surface at said predetermined position.

3. The process set forth in claim 1 wherein said component is a snap-action switch and said actuating member moves linearly, and said change of state is the changeover operation of said switch.

4. The process set forth in claim 3 wherein said actuating member is held by being clamped by jaws having relative movement transverse to the line of said linear actuating movement.

5. The process set forth in claim 3, wherein said removal of material is peformed by broaching.

6. The process set forth in claim 3 wherein said monitoring of the change of state is achieved by a control circuit connected to contacts of said switch.

7. The process set forth in claim 1 wherein, if the instant in the travel of said actuating member at which said change of state takes place is outside predetermined limits said component is automatically sorted out.

* * * * *